United States Patent [19]

Miles

[11] 3,954,067

[45] May 4, 1976

[54] REVERSIBLE PALLET

[76] Inventor: Ray P. Miles, 8575 Melody Lane, Macedonia, Ohio 44056

[22] Filed: Nov. 22, 1974

[21] Appl. No.: 526,305

[52] U.S. Cl. ..... 108/57; 52/481; 108/51

[51] Int. Cl.[2] ..... B65D 19/38

[58] Field of Search ..... 108/51–58; 52/481, 729

[56] References Cited

UNITED STATES PATENTS

| | | | |
|---|---|---|---|
| 176,307 | 4/1876 | Healy | 52/729 |
| 741,421 | 10/1903 | Weber | 52/729 |
| 2,311,280 | 2/1943 | Quayle | 108/57 |
| 2,640,669 | 6/1953 | Ashford | 108/53 X |
| 3,472,182 | 10/1969 | Eklund | 108/51 |
| 3,602,157 | 8/1971 | Cohen | 108/51 |
| 3,645,215 | 2/1972 | Kirkpatrick | 108/51 |
| 3,726,236 | 4/1973 | Colas | 108/51 |
| 3,868,915 | 3/1975 | Hafner | 108/51 |

FOREIGN PATENTS OR APPLICATIONS

| | | | |
|---|---|---|---|
| 142,000 | 1/1935 | Austria | 52/729 |

*Primary Examiner*—Roy D. Frazier
*Assistant Examiner*—William E. Lyddane
*Attorney, Agent, or Firm*—Millen, Raptes & White

[57] ABSTRACT

A metal pallet which is double faced and reversible comprises parallel spaced faces of spaced planks. The faces are fabricated separately wherein the planks of each face are secured by welding to transverse end and an intermediate stringers. The end stringers comprise male and female members, each of which is welded during fabrication to the opposite faces. Similarly, an intermediate stringer of two female members having offset U-shaped sections, are each welded to the opposite faces. The two faces are welded together by joining the said end male and female members and said intermediate female members.

4 Claims, 3 Drawing Figures

REVERSIBLE PALLET

BACKGROUND OF THE INVENTION

This invention relates to platforms for handling various types of material and more particularly to industrial pallets used with fork lift trucks and the like.

Generally, industrial pallets were usually constructed of wood, because of its ready availability and its low cost. However, recently the cost of lumber has risen considerably and it is not as readily available as it used to be. Furthermore, wood pallets are fire hazards and during normal use, eventually warp, rot and deteriorate and become splintered at their edges and corners. The deteriorated conditions can cause injuries to workmen handling them. Accordingly, the wood pallets require frequent replacement. In addition, wood pallets are usually relatively thick and heavy in weight and therefore the handling of them is difficult. The use of the heavy pallets limits the weight of material that can be carried on the pallet as handled by a fork lift truck having a limited lifting capacity.

Wooden pallets are usually fabricated by nailing planks together to form a box-like frame comprising an elevated load-carrying platform under which the forks of the fork lift truck engage the pallet to raise it. Inevitably, along with the other disadvantages recited above, looseness occurs at the joints after continued use.

BRIEF SUMMARY OF THE INVENTION

In accordance with this invention, a pallet is provided constructed of a metal, preferably aluminum, which is strong, durable, and light in weight. In addition a novel method is provided for fabricating a metal pallet.

Accordingly, it is an object of the invention to provide a novel pallet construction having a double face fabricated from metal.

It is another object of this invention to provide a novel pallet construction fabricated from metal comprising two platforms whereby either side of the pallet can be used as the load carrying surface.

A further object of the invention is to provide a simplified method for fabricating a metal pallet.

DETAILED DESCRIPTION OF THE INVENTION

The above objects, features, and advantages of the invention will be more apparent by reference to the following specification and accompanying drawings in which.

Figure 1:
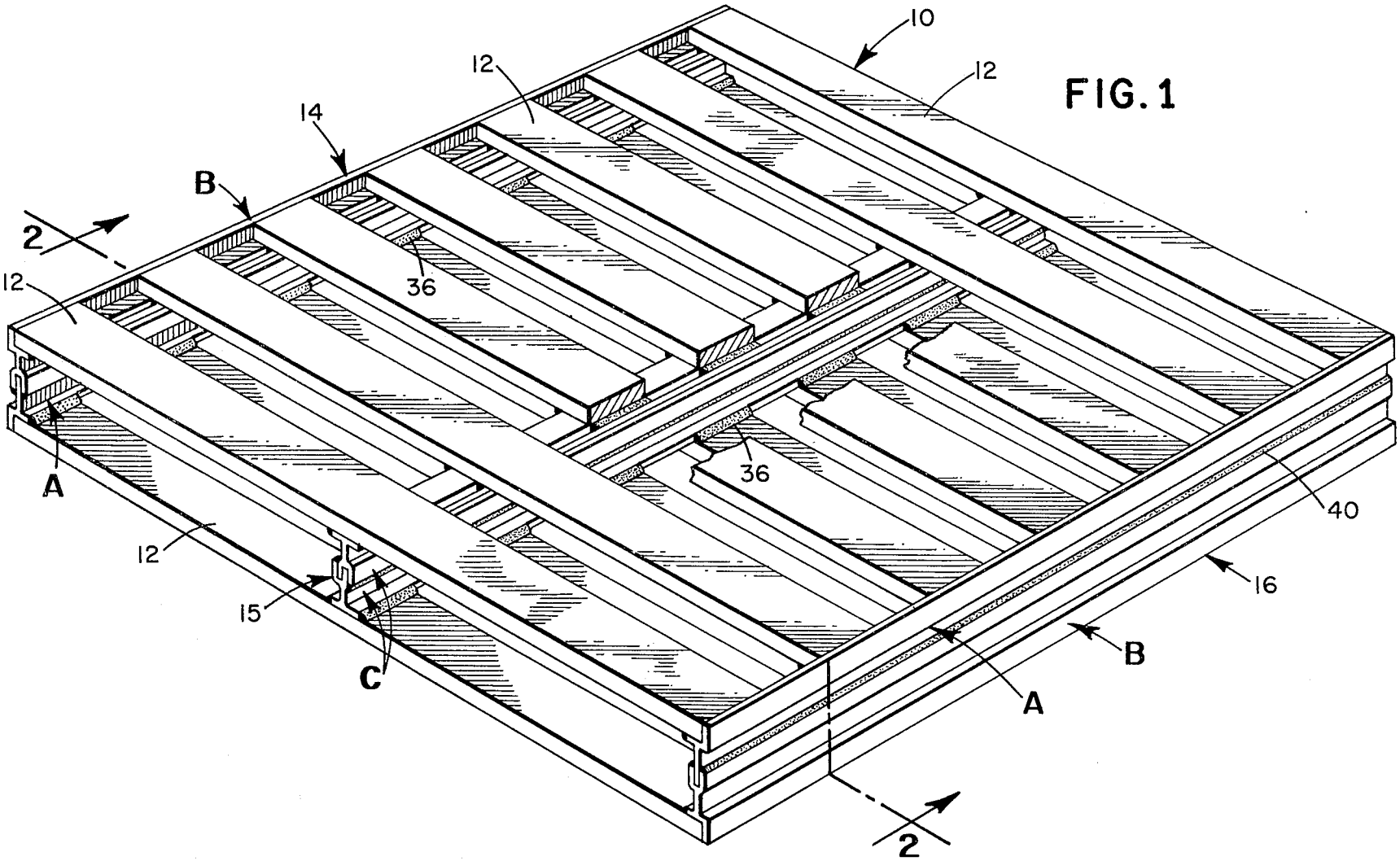
FIG. 1 is a perspective elevational view of a pallet embodying the features of this invention.
Figure 2:
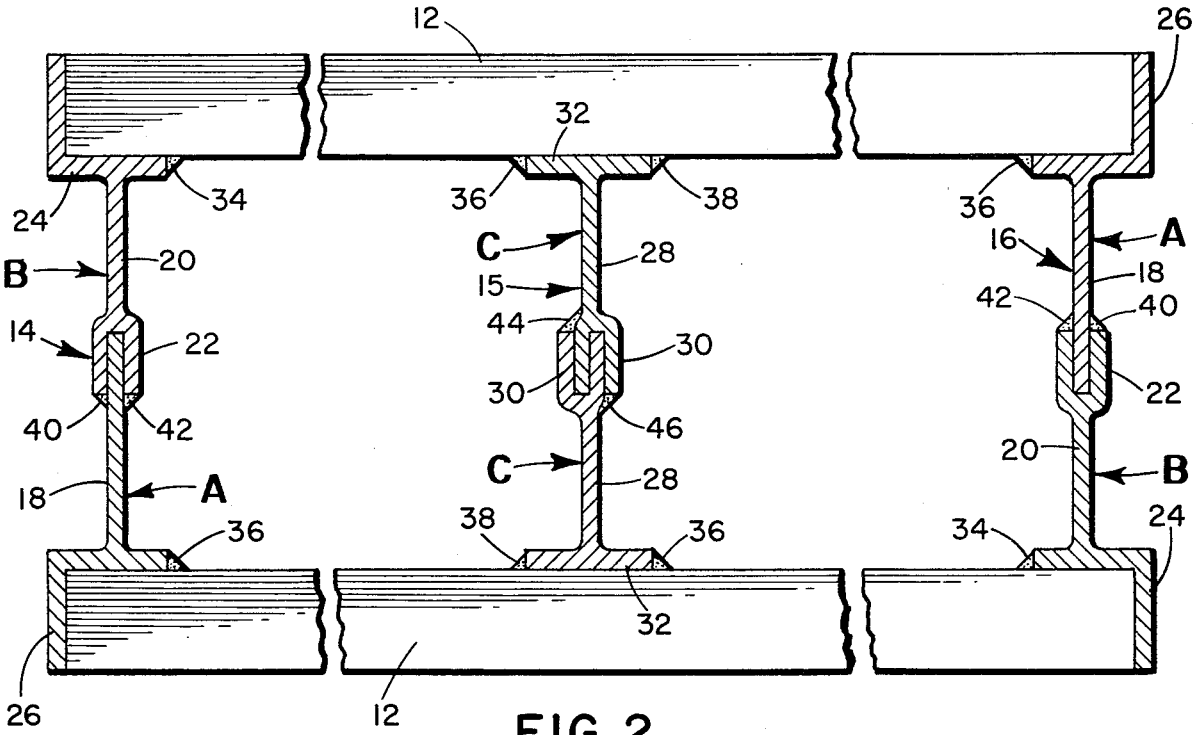
FIG. 2 is an enlarged view of the end frames of the pallet of FIG. 1.
Figure 3:
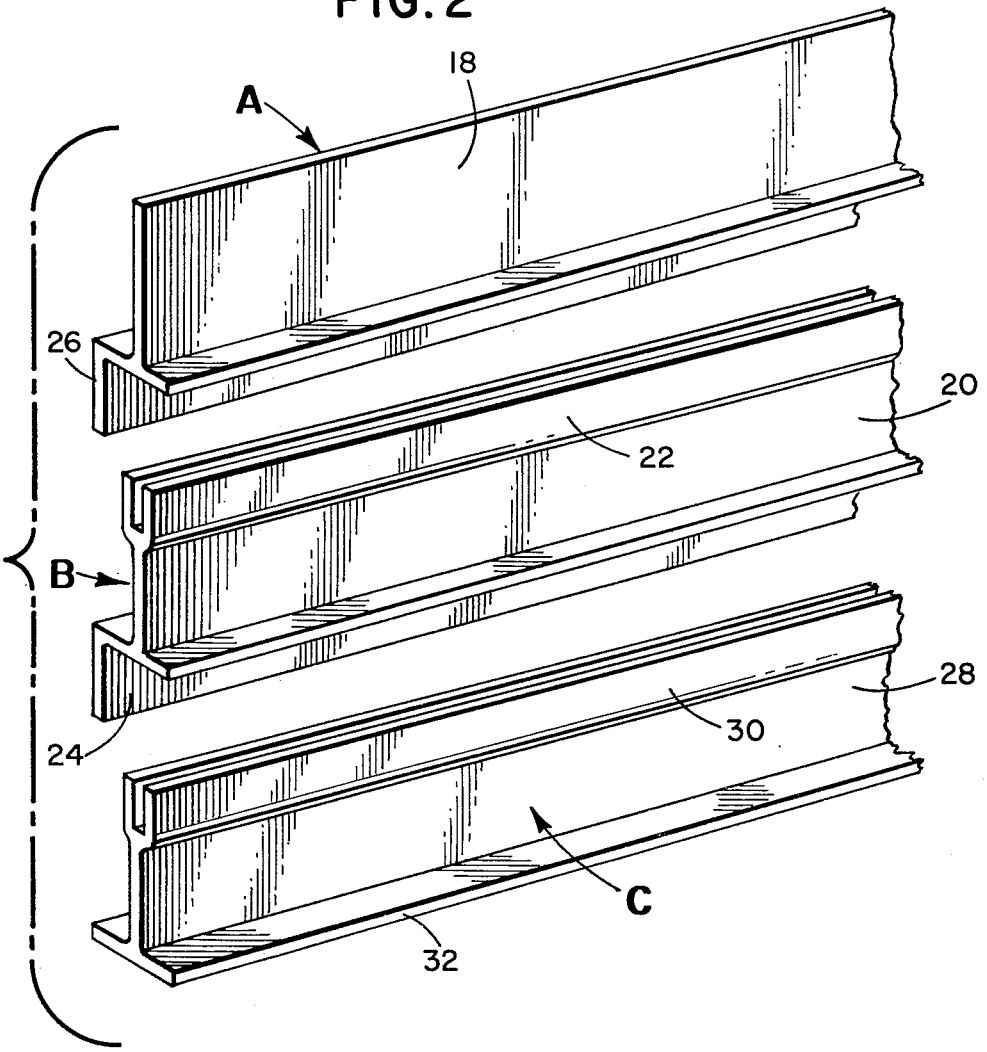
FIG. 3 shows partial perspective views of elements A, B, and C used to form the stringers in constructing the pallet of the invention.

Referring specifically to the drawings, the numeral 10 generally denoted a pallet fabricated according to the invention herein. The pallet is made from rectangular aluminum planks 12. The planks are secured to three spaced legs or stringers 14, 15 and 16.

The pallet is constructed from a plurality of planks 12 which are disposed to form two, parallel, load bearing surfaces. Thus, the pallet has a double face and is reversible so that either surface can be used for carrying loads. Each surface comprises a series of planks, the ends of which are secured to stringers 14 and 16. The medial sections of the planks are secured to stringer 15.

Stringers 14 and 16 each comprise a male member A and a female member B. The male member A comprises an arm 18 and an L-shaped section 26. The female member B comprises an arm 20 having an L-shaped section 24 at one end and a U-shaped section 22 at the other end. Sections 18 and 22 are designed to be fitted together and the L-shaped sections 26 are designed to retain the ends of the planks 12.

Stringer 15 is designed to be located within the pallet and comprises two identical female members C. Member C comprises an arm 28 having an offset U-shaped section 30 at one end and a platform section 32 at the other end. The two female members C are designed to be fitted together at their offset U-shaped sections, and thereby their respective arms 28 are aligned on the same center line. Pressure from a load on the pallet is thereby transmitted evenly through the respective arms 28.

A particular advantage of the pallet of this invention is the simplicity in which its fabrication can be accomplished. Thus, in accordance with one aspect of the invention, the method of fabricating the pallet is as follows. The planks 12 are arranged in a work piece to form one face of the pallet. A male member A is positioned with L-shaped section 26 against one end of the planks and a female member B is positioned with L-shaped section 24 against the opposite end of the planks. Using suitable welding equipment, all the planks are easily and quickly welded to the male and female members A and B at the junctures 34 and 36 along the planks.

Similarly, the second face of the pallet can be fabricated. A female member C is welded to the center of the underside of each face along the planks at junctures 36 and 38. The two faces joined by inserting male members A respectively in female members B of each face and by inserting female member C into each other. Members A and B are welded at several places along their junctures 40 and 42, with easy access to the juncture 42 for welding being between the planks. The final welding required is at several places along the junctures 44 and 46 of members C. Again easy access to the junctures for welding between the planks.

The pallet of the invention is durable and strong. Having two usable faces, it is versatile in its use. The forks of a fork lift truck can be inserted from either end of the pallet. A particular advantage of the pallet is that it can be fabricated from four basic metal parts, i.e., planks all of equal size and stringer members A, B, and C. The pallet can be fabricated from any suitable metal such as iron, magnesium and the like. However, aluminum is particularly suitable for fabricating the pallet.

What is claimed is:

1. A reversible metal pallet comprising a pair of parallel faces spaced apart and secured together by stringers, said pallet constructed from four basic components as follows:

A. longitudinal end stringer members, each comprising an L-shaped section and a male connecting member affixed perpendicularly to the outside of one leg of the L-shaped section, B. longitudinal end stringer members, each comprising an L-shaped section and a female connecting member affixed perpendicularly to the outside of one leg of the L-shaped section, C. longitudinal intermediate stringer members, each comprising a platform section and an offset U-shaped connecting member affixed perpendicularly to said platform section, D. longitudinal planks, each of said pallet faces comprising:

1. a plurality of said parallel planks in parallel spaced relation,
2. a longitudinal stringer member as set forth in (A) having said L-shaped section secured transversely across one end of each of said parallel planks,
3. a longitudinal stringer member as set forth in (B) having said L-shaped section secured transversely across the opposite end of each of said parallel planks,
4. a longitudinal stringer member as set forth in (C) having said platform section secured transversely across an intermediate underportion of each of said planks, said pallet faces secured in opposite parallel spaced relation by respective male members interlocked with respective female members, and also be interlocked respective offset U-shaped members, and said components secured together at several places at their junctures.

2. The pallet of claim 1 wherein said metal is aluminum.

3. The pallet of claim 1 wherein said end and said intermediate stringer members are welded to the planks at the junctures therewith.

4. The pallet of claim 1 wherein said male and female members of said end stringer members are welded together and said U-shaped members of said intermediate stringer members are welded together.

* * * * *